United States Patent [19]

Orlov et al.

[11] 4,157,637

[45] Jun. 12, 1979

[54] PLANETARY-TYPE LAPPING MACHINE FOR LAPPING A GROUP OF WORKPIECES

[75] Inventors: Petr N. Orlov, Moscow; Mukim M. Khasanov, Dushanbe; Vladimir G. Nedospasov, Dushanbe; Valery A. Peshkov, Dushanbe; Alexandra A. Savelova, Moscow, all of U.S.S.R.

[73] Assignee: Moskovskoe Vysshee Tekhnicheskoe Uchilische Imeni N.E. Baumana, U.S.S.R.

[21] Appl. No.: 829,151

[22] Filed: Aug. 30, 1977

[51] Int. Cl.[2] ..... B24B 7/16

[52] U.S. Cl. ..... 51/133; 51/118

[58] Field of Search ..... 51/118, 131 R, 131 A, 51/131 B, 133

[56] References Cited

U.S. PATENT DOCUMENTS

| | | | |
|---|---|---|---|
| 2,963,830 | 12/1960 | Hook | 51/131 |
| 2,973,605 | 3/1961 | Carman | 51/133 X |
| 3,089,292 | 5/1963 | Hunt | 51/118 |
| 3,097,458 | 7/1963 | Richmond | 51/118 X |
| 3,662,498 | 5/1972 | Caspers | 51/118 |

FOREIGN PATENT DOCUMENTS

| | | | |
|---|---|---|---|
| 1577322 | 1/1970 | Fed. Rep. of Germany | 51/133 |

*Primary Examiner*—Nicholas P. Godici

*Attorney, Agent, or Firm*—Robert E. Burns; Emmanuel J. Lobato; Bruce L. Adams

[57] ABSTRACT

A method and apparatus for lapping workpieces or components. A planetary-type plane lapping machine has a stationary lapping disc and a rotary driven rotary lapping disc. A cage having a socket for holding work to be lapped is disposed between the stationary lapping disc and the rotary lapping disc. The cage is a planet gear driven by a sun gear and a ring gear of a sun-and-planet gear. A differential gear train couples the sun gear with the rotary disc for driving the rotary lapping disc and a differential mechanism controls the direction of wear of the working surfaces of the lapping discs. In order to carry out the method disclosed the rotary lapping disc is driven rotationally at substantially twice the speed at which the center of the cage rotates about the axis of rotation of the rotary lapping disc. This precludes the development of forces of the work being lapped from acting on the cage.

2 Claims, 5 Drawing Figures

PLANETARY-TYPE LAPPING MACHINE FOR LAPPING A GROUP OF WORKPIECES

BACKGROUND OF THE INVENTION

The invention relates to machine tools and more particularly to planetary-type lapping machines and to methods for lapping of a group of workpieces on such machines.

The machines of the above-mentioned type are designed for machining parallel surfaces of components of hard and fragile materials with a free abrasive tool, such as for machining of piezoquartz plates having a thickness of up to 100 mcm, and such machines are provided with a mechanism for kinematic dressing of lapping tools during machining.

Known planetary-type lapping machines comprise a lower lapping disc and an upper lapping disc and cages containing components being machined which are arranged between the discs and driven by a sun gear and a ring gear of a sun-and-planet gear which are rotated on vertical shafts coaxial with the stationary lower lapping disc and rotary upper lapping discs (lapping tools). In such machines, circumferential speeds of the cage center relative to the surface of the lapping discs are about equal and opposite, and there is provided a mechanism for rotating the upper lapping disc which is driven by one of the links of the sun-and-planet gear of the machine (cf. USSR Inventor's Certificate No. 1492911).

Alongside with the advantages of such construction of the machine consisting in that there is provided a stationary base surface (lower lapping disc), the cage is relieved because forces of friction of the plate over the surface of the lapping discs are directed at an obtuse angle, and there is a possibility of movement of the workpieces being machined along spiral paths, there are also a number of disadvantages, such as discussed hereinbelow.

The plates being machined can only move, over the surfaces of the lapping tools, along "circular" paths which results in an increased wear of teeth due to a large number of plates being machined in the cage and high circumferential speed of the cage teeth relative to the teeth of the sun and ring gears of the sun-and-planet gear. The cage size is equal to the size of the sun gear so that it is impossible to make a machine having narrow lapping tools and smaller cages which is especially important in machining thin plates.

It is known that the smaller the cage, the lower the number of plates loaded therein, hence the lower the resultant force (composed of all friction forces acting on each plate) applied to the cage. With the cage and sun gear sizes being equal, reduction of the cage dimensions results in reduced dimensions of the lapping discs and lower number of concurrently machined plates, hence productivity decreases.

Where the equality of sizes of the cage and sun gear is not required, a machine with smaller cages and a larger number of them may be made. Therefore, with the same outside dimensions of the lapping discs, the number of concurrently machined plates remains the same since a larger number of smaller cages are loaded in the machine.

Known machines, such as the lapping machine AL-2 manufactured by Peter Wolters (West Germany) provide for kinematic dressing by concurrently reversing the lower and upper lapping discs; it is, however, impossible to machine thin plates to high accuracy using such machine, since both lapping discs are rotatable. The reverse of the upper lapping disc with the stationary lower lapping disc would not bring about a desired result because the cages could not be unloaded, hence minimum thickness would be unobtainable.

SUMMARY OF THE INVENTION

It is an object of the invention to provide a planetary-type plane lapping machine which enables machining of plates (components) of minimum thickness, such as of 60–80 mcm with thickness differentials within the range from 0.25 to 0.5 mcm.

Another object of the invention is to provide a planetary-type plane lapping machine which ensures uniform wear over the entire working surface of the lapping tool during machining.

An object of the invention is to provide a planetary-type plane lapping tool which provides for reduction or complete elimination of the action of components being machined on the cage.

Another object of the invention is to provide a planetary-type plane lapping machine which enables the control of directive wear of the working surfaces of the lapping tools during machining.

Still another object of the invention is to provide a planetary-type lapping tool in which the above-mentioned advantages are obtained due to relatively simple and inexpensive modifications of existing planetary-type lapping machines.

It is also an object of the invention to provide a planetary-type plane lapping machine which enables substantial lowering of requirements imposed on the cage material.

Another object of the invention is to provide a planetary-type plane lapping machine in which force application on the part of the cage teeth to the sun gears teeth is eliminated.

And finally, it is an object of the invention to provide a planetary-type plane lapping machine in which the service life of gears is prolonged by more than 100 times.

For the accomplishment of the above objects, according to the invention, there is contemplated a method for lapping a group of workpieces in cages on planetary-type plane lapping machines in which the components being machined are arranged between rotary lapping discs and a stationary lapping disc. The method is characterized in that the rotary lapping disc is driven at approximately doubled angular speed compared to the angular speed of rotation of the cage centers about the axis of rotation of the lapping disc thereby relieving the cages from the action of the components being machined.

There is also contemplated a planetary-type plane lapping machine for carrying out the above-described method comprising a stationary lapping disc and rotary lapping discs, the components being machined being arranged in cages between the discs, the cages being formed as planet pinions of a sun-and-planet gear driven by a sun gear and a ring gear, characterized in that there is provided a differential gear link inserted between the sun gear and the rotary lapping disc for making the gear ratio between the sun gear and the lapping disc of about 1:2.

This construction enables the elimination of force transmitting action of the components being machined on the cage due to opposite direction of friction forces developing during machining between the components and working surfaces of lapping tools at the opposite sides of the plate being machined.

In accordance with one embodiment of the invention, there is provided a plane lapping machine characterized in that the differential gear link providing for the above-mentioned angular speed ratio comprises a cross-piece rigidly connected to the sun gear, the cross-piece supporting loosely mounted intermeshing pinions meshing with a pair of other pinions coaxial with the sun gear, one pinion being fixed and the other being in a driving connection with the rotary lapping disc by means of a carrier.

This construction provides the most preferable means for elimination of force transmitting action of the components being machined on the cage according to the first embodiment of the invention. Such technical solution permits the use of an independent drive of the upper lapping tool to be dispensed with due to the provision of the differential mechanism for driving the upper lapping disc directly from the central shaft.

And finally, according to still another modification of the invention, there is provided a plane lapping machine characterized in that the force transmitting connection of the drive of the sun gear of the sun-and-planet lapping gear includes a differential mechanism for controlling the directive wear of the working surfaces of the lapping discs which comprises a reversible electric motor, a reduction gear, and intermediate gear, two sun gears, a carrier and planet pinions.

This construction enables the elimination of force transmitting action of the components being machined on the cage as in the case of the first embodiment of the invention and also enables kinematic dressing of lapping tools during machining by varying the kinematic performance.

BRIEF DESCRIPTION OF THE DRAWINGS

The invention will now be described in details with reference to the accompanying drawings, in which.

DESCRIPTION OF THE PREFERRED EMBODIMENTS

Known planetary lapping machines comprise an upper and a lower lapping tools and cages arranged therebetween and driven by sun and ring gears rotating on vertical rotary shafts. Plates being machined are placed in sockets of the cages and lapped over the plane surfaces of the lapping tools.

The existing types of plane lapping machines enable machining of plane parallel surfaces of components of various materials to high accuracy and at high performance. Alongside with the above, these machines offer restricted opportunities in machining thin plates, and to obtain high accuracy of components being machined, the lapping tools should be removed from the machine, and the working surface of the lapping tools should be dressed.

In addition, high loads on the cages at the points of contact with the components being machined and at the points of contact of teeth with the sun gears result in a rapid wear of the cages and crowns of the sun gears.

It is obvious that the obtainable thickness of the plates to be simultaneously machined on both sides depends to a great extent on the cage strength. The cage is used for placing and holding the components being machined. The cage takes-up forces applied on the part of the sun gears to the gearing points, as well as forces of useful resistance on the part of the upper and lower lapping tools which are applied to the cage through the components being machined.

The experience of lapping of plates with a thickness exceeding 0.5 mm offers a large variety of materials for the manufacture of cages. However, in machining plates of a thickness smaller than 0.5 mm using the same materials, the load on the cage is to be lowered.

This is practically possible by selecting such kinematic performance for the actuating mechanism of the lapping machine with which the resultant force ($\Sigma P$) during machining has a minimal and sufficiently steady value within the cycle.

In machining plates on a lapping machine having stationary lapping tools, directions of the resistance forces ($P_{14}$ and $P_{24}$) coincide since the plate center moves along the paths of similar configurations over the surface of lapping tools.

FIG. 1 shows:

(a) a diagram showing the direction of relative speeds and resistance forces in machining plates between stationary lapping tools 1 and 2;

(b) the same, with machining of plates between lapping tools 3,4 rotating in opposite directions;

(c) the same, with machining of plates between a stationary lower and rotary upper lapping tools 5,6.

Figures 1A, 1B, 1C:
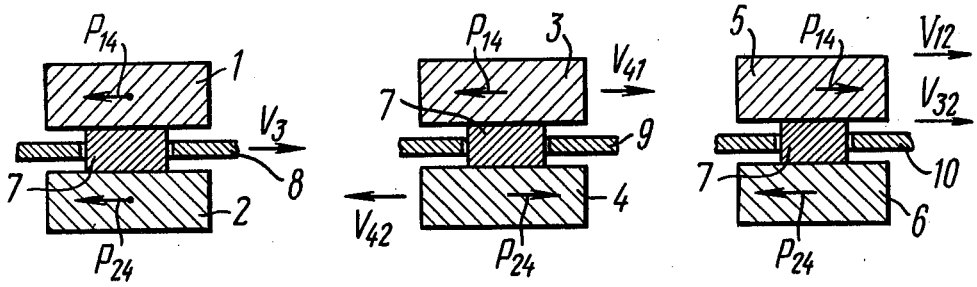
FIGS. 1*a*, 1*b*, and 1*c* are schematic sectional views illustrating the machining of workpieces on a plane lapping machine according to the invention.

The first system for machining plates 7 provides for high accuracy of machined plates which is due to the provision of the stationary support base formed by the lower lapping tool 2. However, when using this system (FIG. 1*a*), a cage 8 takes-up maximum load since useful resistance forces are applied in the same direction ($\Sigma P = P_{14} + P_{24}$).

In machining plates on a lapping tool having the oppositely rotating lapping tools 3,4 (FIG. 1*b*), resistance forces $P_{14}$ and $P_{24}$ are opposite. A cage 9 is loaded with a low force which is equal to the difference in the resistance forces $\Sigma P = P_{14} - P_{24}$. This system provides for machining of thin plates 7, however, the absence of a stationary support base hampers high-accuracy machining of the plates.

In machining plates on the lapping machine with the stationary lower lapping tool 6 (FIG. 1*c*) and the rotary upper lapping tool 5, an additional condition should be complied with: speeds of movement of the component 7 being machined relative to the upper and lower lapping tools 5,6, respectively, should be about equal. This is necessary to obtain the same rate of removal of the allowance from both sides of the plate.

Therefore, the construction of the machine, in which the lower lapping tool 6 is stationary, the center of a cage 10 moves at an angular speed $\omega_3$, and the upper lapping tool rotates at an angular speed $\omega_1 = 2\omega_3$, provides for machining of thin plates due to the fact that the cages are relieved from resistance forces on the part of the plates being machined and ensures high accuracy of machining due to the maintenance of a stationary support base since the lower lapping tool 6 is stationary.

In practice, this system of machining may be carried out if the selection of kinematic performance of a planetary type plane lapping machine provides for approximate equality of angular speeds of the sun gears $\omega_5=\omega_6$, the mandatory condition being $\omega_1\neq\omega_3$. In such case, the angular speed of the upper lapping disc (lapping tool) should be by about two times higher than the angular speed of the sun gear.

This construction of the machine ensures the movement of the center of plates being machined along spiral paths over the working surfaces of the lower and upper lapping tools. In this case, the angle between vectors of circumferential speeds or resistance forces on the side of the upper and lower lapping tools only slightly differs from 180° at any point of the lapping tool surface.

Figure 2:
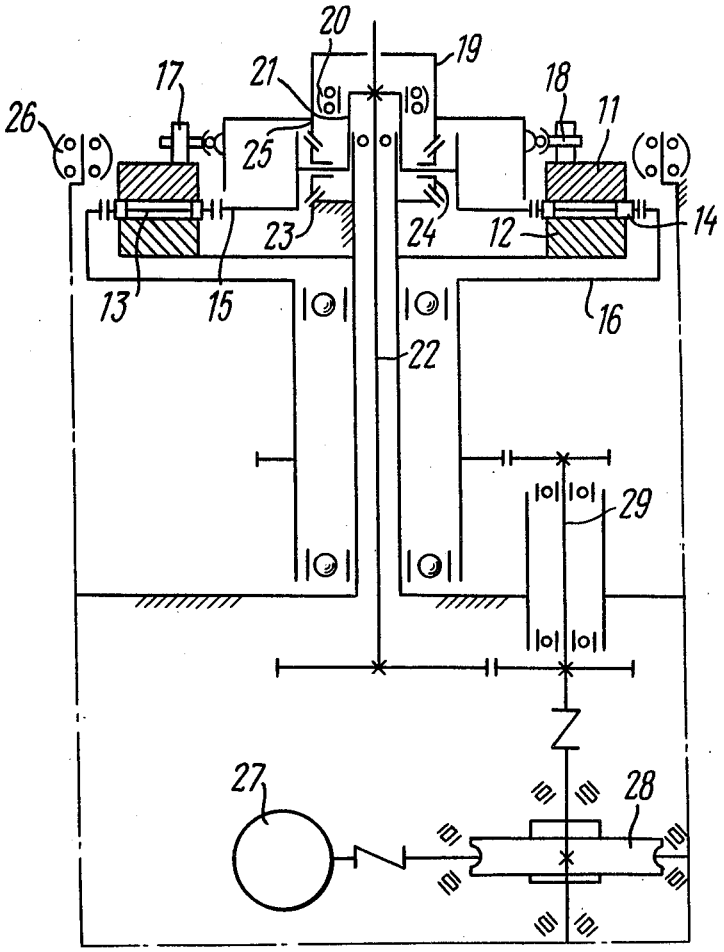
FIG. 2 is a diagrammatic view of a first embodiment of the invention with the drive of an upper lapping disc directly from the central shaft.

Therefore, in one embodiment of the invention, the lapping machine comprises an upper lapping disc 11 (FIG. 2) and a lower lapping disc 12, and cages 13 arranged between them. Plates 14 being machined are placed in sockets of the cages 13. The cages 13 mesh with teeth of a sun gear 15 and a ring gear 16 a sun-and-planet gear. The upper lapping disc 11 has stops 17 engaging pins 18 of a double-speed multiplier. The double-speed multiplier comprises a carrier 19, a spherical bearing 20, a cross-piece 21 rigidly fitted on a central shaft 22, a support gear 23, planet pinions 24 and a ring gear 25 of the multiplier. The upper lapping disc 11 is journalled in support rollers 26. The machine also comprises an electric motor 27, a reduction gear 28 and an intermediate shaft 29.

Upon energization of the electric motor 27, rotary motion is transmitted, via the reduction gear 28 and intermediate shaft 29, to the central shaft 22 and ring gear 16 of the sun-and-plant gear. The sun gear 15 of the sun-and-planet gear and the cross-piece 21 are rigidly secured to the central shaft 22 so that they are driven at the same angular speed. The planet pinions 24 fixed to the carrier 19 roll over the support gear 23 to drive ring gear 25 of the double-speed multiplier at an angular speed which is twice the speed of the sun gear 15 of the sun-and-planet gear.

Figure 3:
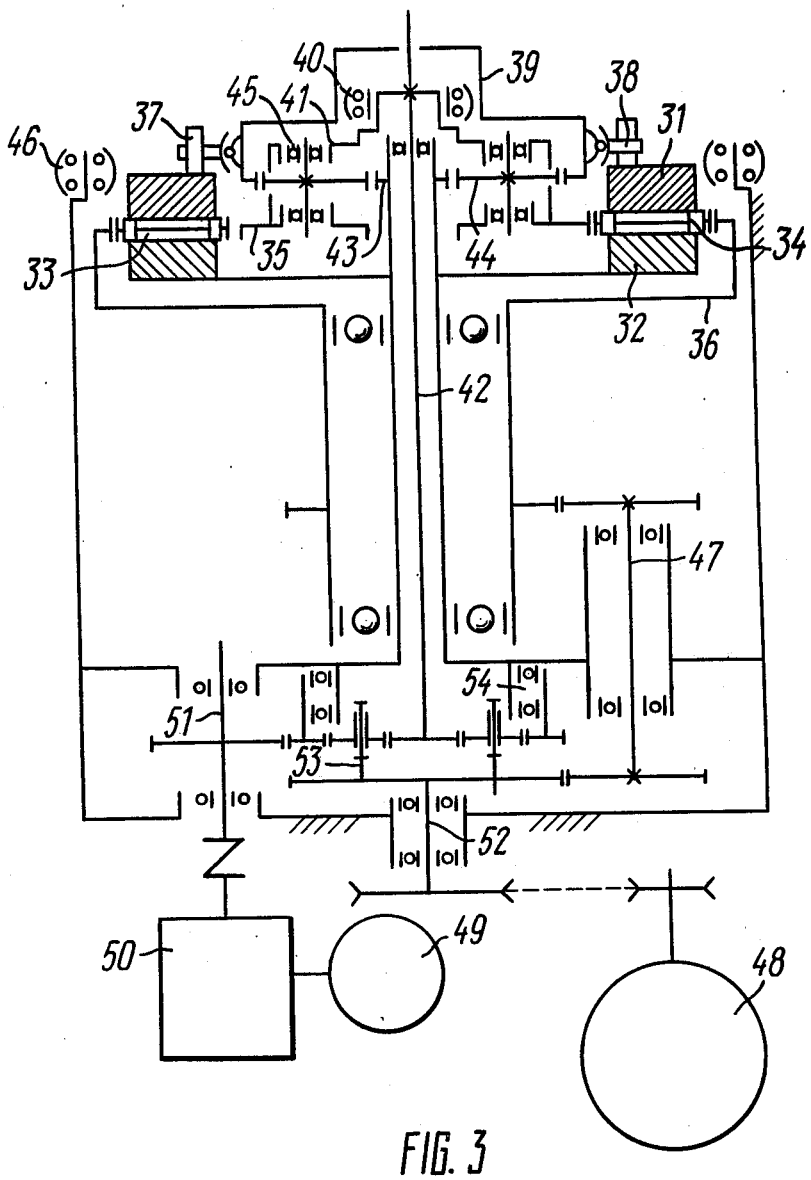
FIG. 3 is a diagrammatic view of a second embodiment of the lapping machine according to the invention with a differential drive of the upper lapping disc.

In accordance with another embodiment of the invention, the lapping machine comprises an upper lapping disc 31 (FIG. 3) and a lower lapping disc 32, and cages 33 arranged between the discs. Plates 34 being machined are placed in sockets of the cages 33. The cages mesh with teeth of a sun gear 35 a ring gear 36 of a sun-and-planet lapping gear. The upper lapping disc has stops 37 which engages pins 38 of a sun-and-planet gear driving the upper lapping disc comprising a carrier 39, a spherical bearing 40, a cross-piece 41 rigidly fitted on a central shaft 42, a support gear 43, planet pinions 44 and a ring gear 45 of a double-speed multiplier. The upper lapping disc is journalled in rollers 46. In addition, there are provided a distribution shaft 47 and an electric motor 48.

The machine also comprises a correction mechanism which consists of a reversible electric motor 49, a worm gearing 50 having a self-braking worm couple, intermediate shafts 51 and 52, a carrier 53 and an internal gear 54.

The system according to the invention involves the operation of the machine in three different modes:

A- conventional mode, B- correction of the discs with depression towards the center, C- correction of the discs with depression towards the periphery.

During operation in the mode A, the motor 48 is turned on, and the correction motor 49 is turned off. The worm gearing 50 brakes the gear 54 of the sun-and-planet correction gear. Motion from the motor 48 is transmitted, via the intermediate shaft 52, carrier 53, intermediate shafts 42 and 47, to the sun gear 35 and ring gear 36 of the sun-and-planet lapping gear. The upper lapping disc 31 is driven, via the sun-and-planet drive gear including the members 41,44,39 and stops 37. With the time, the lapping disc is worn from the center towards the periphery. In such case, the motor 49 is put on to rotate in a selected direction to increase or decrease the rotational speed of the external gear 36 and provide for a change of the path so that the lapping discs 31 and 32 are dressed during machining of the plates 34.

Thus, in order to the obtain steady accuracy of the plates being machined in the lapping machine according to the invention, there is provided, in the force transmitting system of the machine, which connects the sun gear to the ring gear, a second sun-and-planet gear driven by the worm gearing incorporating a self-braking worm couple and an individual reversible electric motor which is necessary for correction of the worn working surface of the lapping tools. The worn surface is convex or concave.

Generally, the machine operates with the correction electric motor off. In a certain time, when a directive wear of the lapping tools appears, the correction electric motor is put on, and the rotational direction of the motor depends on the shape of the worn surface (convex or concave). The mechanism according to the invention permits the plane parallelism of the lapping disc to be maintained during a long time.

Alongside with the relief of the cages from force application on the part of the plates being machined, this system prolongs the life of teeth, cages and sun gears for two reasons. First, alongside with the reduction of the resistance forces, the forces in the gearing are also lowered. Second, with $\omega_5=\omega_6$, the relative sliding speed of the teeth is reduced.

The above-mentioned advantages of the machine according to the invention may be summarized as follows: (1) the cages are relieved from forces applied on the part of the plates being machined; (2) service life of the carriages and sun gear teeth is prolonged; (3) the shape of the worn surface of the lapping discs is stabilized, and these advantages may be achieved in lapping machined independently on one another so as to obtain savings in operation of the machines, the above principles being theoretically elaborated and tested. However, it is noted that it is the comprehensive incorporation of all technical solutions described above in a single machine that enables the provision of a plane lapping machine coping with stringent production requirements of stability, accuracy and productivity in machining thin plates.

We claim:

1. A planetary-type plane lapping machine comprising: a stationary lapping disc; a rotary driven rotary lapping disc; a cage having sockets for containing components to be lapped between the stationary and rotary lapping discs; a sun-and-planet lapping gear comprising a planet pinion constituting said cage, a sun gear and a ring gear driving said planet pinions; a differential gear link effecting a force transmitting connection of said sun gear with said rotary lapping disc for driving said rotary lapping disc at an angular speed approximately double the angular speed of rotation of a center of the cage about an axis of rotation of said rotary lapping disc thereby relieving the cage of application of forces by said components when being lapped; said differential gear link comprising a cross-piece rigidly connected to the sun gear, a pair of pinions, intermeshing pinions supported on said cross-piece and meshing with said pair of pinions, one pinion of said pair of pinions being fixed and the other pinion being in driving connection with said rotary lapping disc, and carrier means providing said driving connection.

2. A planetary-type plane lapping machine comprising, a stationary lapping disc; a rotary driven rotary lapping disc; a cage having a socket for holding a component to be lapped between said stationary lapping disc and said rotary lapping disc; a sun-and-planet lapping mechanism having a sun gear and a ring gear, said cage comprising a planet gear driven by said sun gear and ring gear; a differential gear train coupling said sun gear with said rotary disc for driving the rotary lapping disc at substantially twice the speed at which a center of said cage rotates about an axis of rotation of said rotary lapping disc, and a differential mechanism having means for controlling the direction of wear of working surfaces of the lapping discs.

* * * * *